US009327513B2

(12) United States Patent
Moriguchi et al.

(10) Patent No.: US 9,327,513 B2
(45) Date of Patent: May 3, 2016

(54) PRESSURE REGULATING UNIT, LIQUID SUPPLYING APPARATUS, AND LIQUID EJECTING APPARATUS

(71) Applicant: CANON KABUSHIKI KAISHA, Tokyo (JP)

(72) Inventors: Takuto Moriguchi, Kamakura (JP); Shuzo Iwanaga, Kawasaki (JP); Kazuhiro Yamada, Yokohama (JP); Zentaro Tamenaga, Sagamihara (JP); Takatsugu Moriya, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/685,820

(22) Filed: Apr. 14, 2015

(65) Prior Publication Data

US 2015/0314606 A1 Nov. 5, 2015

(30) Foreign Application Priority Data

Apr. 30, 2014 (JP) ..... 2014-093717
Feb. 24, 2015 (JP) ..... 2015-034164

(51) Int. Cl.
*B41J 2/175* (2006.01)

(52) U.S. Cl.
CPC ..... *B41J 2/17596* (2013.01)

(58) Field of Classification Search
CPC .... B41J 2/175; B41J 2/17513; B41J 2/17523; B41J 2/17556; B41J 2/17596; G05D 16/0644; G05D 16/0655; G05D 16/0683; Y10T 137/7836
USPC ..... 347/7, 85
See application file for complete search history.

(56) References Cited

U.S. PATENT DOCUMENTS

| | | | | |
|---|---|---|---|---|
| 6,382,786 | B2 | 5/2002 | Iwanaga et al. | 347/86 |
| 6,419,349 | B1 | 7/2002 | Iwanaga et al. | 347/86 |
| 6,527,381 | B1 | 3/2003 | Udagawa et al. | 347/86 |
| 6,652,949 | B2 | 11/2003 | Iwanaga et al. | 428/65.9 |
| 6,742,881 | B2 | 6/2004 | Kotaki et al. | 347/86 |

(Continued)

FOREIGN PATENT DOCUMENTS

JP 3606282 1/2005

OTHER PUBLICATIONS

U.S. Appl. No. 14/692,478, filed Apr. 21, 2014.

(Continued)

*Primary Examiner* — Anh T. N. Vo
(74) *Attorney, Agent, or Firm* — Fitzpatrick, Cella, Harper & Scinto

(57) ABSTRACT

A pressure regulating unit capable of suitably regulating pressure to be applied to liquid, a liquid supplying apparatus, and a liquid ejecting apparatus are provided. An ink communication path allows an ink introducing chamber communicating with an ink inlet and a pressure chamber communicating with an ink outlet to communicate with each other. A part of the pressure chamber is formed of a flexible film. A valve including a valve body and a valve seat adjusts an opening degree of the ink communication path. An urging member applies, to the valve, a first urging force acting in a direction in which the ink communication path is closed. An urging member applies, to the film, a second urging force that is greater than the first urging force and acts in a displacement direction in which the volume of the pressure chamber is reduced.

8 Claims, 10 Drawing Sheets

(56) References Cited

U.S. PATENT DOCUMENTS

| | | | | |
|---|---|---|---|---|
| 7,077,514 | B2 * | 7/2006 | Inoue | B41J 2/17513 347/86 |
| 7,156,507 | B2 | 1/2007 | Aruga et al. | 347/85 |
| 7,278,718 | B2 * | 10/2007 | Aruga | B41J 2/17523 347/85 |
| 7,556,362 | B2 * | 7/2009 | Akahane | G05D 16/0672 347/40 |
| 8,439,481 | B2 * | 5/2013 | Xie | B41J 2/14016 137/337 |
| 8,480,216 | B2 * | 7/2013 | Matsumoto | B41J 2/16523 347/85 |
| 8,517,518 | B2 * | 8/2013 | Kashu | B41J 2/1404 347/66 |
| 2002/0113853 | A1 | 8/2002 | Hattori et al. | 347/86 |
| 2003/0043241 | A1 | 3/2003 | Hattori et al. | 347/86 |
| 2005/0073559 | A1 | 4/2005 | Aruga et al. | 347/85 |

OTHER PUBLICATIONS

U.S. Appl. No. 14/692,486, filed Apr. 21, 2015.

* cited by examiner

PRESSURE REGULATING UNIT, LIQUID SUPPLYING APPARATUS, AND LIQUID EJECTING APPARATUS

BACKGROUND OF THE INVENTION

1. Field of the Invention

The present invention relates to a pressure regulating unit for regulating pressure to be applied to liquid, a liquid supplying apparatus provided with the pressure regulating unit, and a liquid ejecting apparatus.

2. Description of the Related Art

A liquid ejecting apparatus is exemplified by an inkjet printing apparatus for ejecting ink (i.e., liquid) supplied from an ink tank (i.e., a liquid container), ink being ejected from an inkjet print head (i.e., a liquid ejection head) so as to print an image on a print medium. In, for example, a business-grade printing apparatus requiring an improved print speed as the printing apparatus, a large quantity of ink is ejected from the print head. In view of this, a large quantity of ink is required to be supplied to the print head. For this purpose, ink contained in the ink tank is pressurized by a pump or the like, and then, the pressurized ink need be supplied (pressure-supplied). In the meantime, ink, to which a negative pressure is applied, need be supplied to the print head for ejecting the ink from an ejection port in order to suppress the leakage of the ink from the ejection port.

Japanese Patent No. 3606282 discloses an apparatus for regulating the pressure of ink, the apparatus including a pressure regulating unit provided on a supply channel, through which the ink is supplied to a print head. The pressure regulating unit is adapted to regulate the pressure of ink to be pressure-supplied, and to apply a negative pressure to the ink, and then, to supply the ink to the print head. The negative pressure is applied to the ink to be supplied to the print head so as to form a meniscus of the ink at an ejection port. The pressure regulating unit opens or closes a valve disposed on the ink supply channel according to the negative pressure inside of the print head, the negative pressure inside of the print head being varied according to the ejection of the ink, in order to stabilize the negative pressure of the ink inside of the print head.

In a business-grade printing apparatus, in particular, the size of a print head has become greater in recent years so as to further increase a print speed, and therefore, an ink ejection frequency has become higher. Accordingly, an ink supply quantity with respect to the print head is increased.

As the ink supply quantity is increased, a pressure loss in the ink supply channel between the pressure regulating unit and the print head becomes large. The pressure loss causes a possibility that the ink inside of the print head cannot be kept at a proper negative pressure. For example, there is a possibility that the pressure loss causes a difference between a predetermined ink negative pressure regulated by the pressure regulating unit and the negative pressure of the ink inside of the print head, thereby making the negative pressure of the ink inside of the print head insufficient, resulting in ink ejection deficiency.

SUMMARY OF THE INVENTION

The present invention provides a pressure regulating unit capable of suitably regulating pressure to be applied to liquid, a liquid supplying apparatus, and a liquid ejecting apparatus.

In a first aspect of the present invention, there is provided a pressure regulating unit comprising:

a first pressure chamber capable of introducing a liquid therein;

a second pressure chamber capable of leading out the liquid therefrom, at least a part of the second pressure chamber being defined by a displacement member that is displaced according to an inside pressure;

a communication path that allows the first pressure chamber and the second pressure chamber to communicate with each other;

a valve capable of adjusting the opening degree of the communication path according to the displacement of the displacement member;

a first urging unit configured to apply an urging force to the valve, the urging force of the first urging unit acting in a direction in which the communication path is closed; and a second urging unit configured to apply an urging force to the displacement member, the urging force of the second urging unit acting in a displacement direction in which the volume of the second pressure chamber is reduced, wherein a spring constant of the second urging unit being greater than a spring constant of the first urging unit.

In the second aspect of the present invention, there is provided a liquid supplying apparatus for supplying, through a liquid supply channel, a liquid contained in a liquid container to a liquid ejection head capable of ejecting the liquid, wherein the pressure regulating unit in the first aspect of the present invention is provided on the liquid supply channel.

In the third aspect of the present invention, there is provided a liquid ejecting apparatus comprising:

the liquid supplying apparatus in the second aspect of the present invention; and a liquid ejection head capable of ejecting the liquid to be supplied from the liquid supplying apparatus.

In the fourth aspect of the present invention, there is provided an inkjet printing apparatus comprising:

the liquid supplying apparatus in the second aspect of the present invention, the liquid supplying apparatus supplying an ink serving as the liquid;

an inkjet printing head configured to eject the ink to be supplied from the liquid supplying apparatus; and a moving unit configured to relatively move the inkjet printing head and a print medium.

According to the present invention, the valve for adjusting the opening degree of the communication path between the first pressure chamber and the second pressure chamber, and the displacement member that is displaced according to the pressure of the second pressure chamber are associated with each other, and then, the urging force is applied to the displacement member so as to act in the displacement direction in which the volume of the second pressure chamber is reduced. In this manner, it is possible to apply a suitable negative pressure to liquid by utilizing a change in volume of the second pressure chamber, and to supply the liquid.

Further features of the present invention will become apparent from the following description of exemplary embodiments (with reference to the attached drawings).

DESCRIPTION OF THE EMBODIMENTS

First Embodiment

Figure 1:
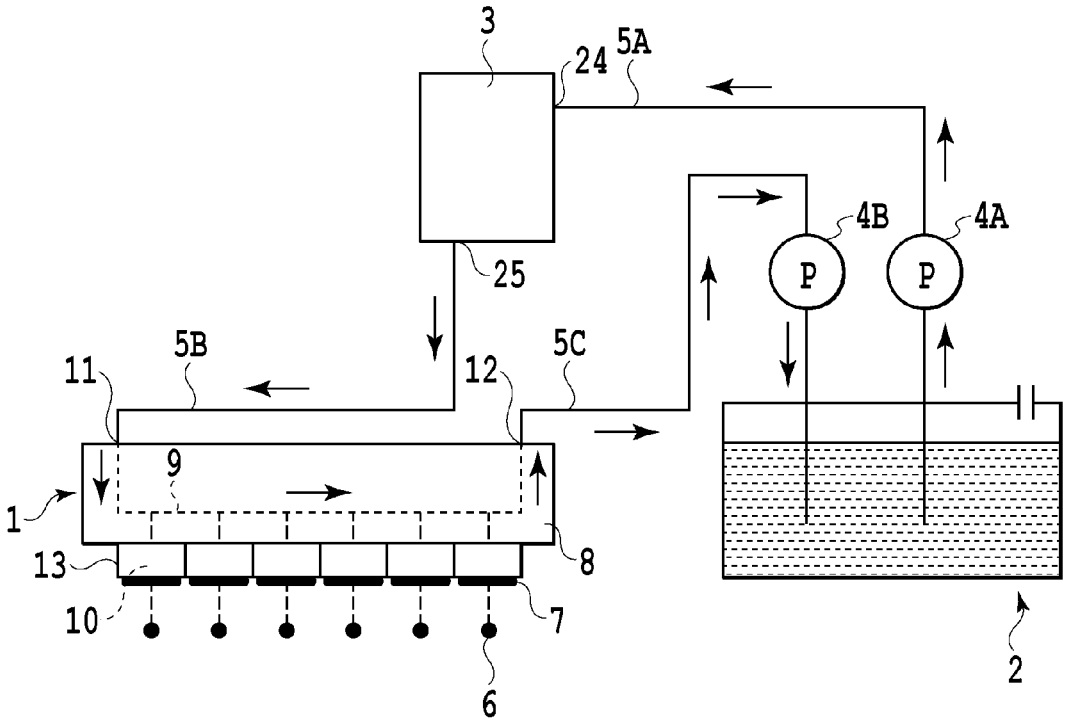
FIG. 1 is a view showing the configuration of an ink supplying apparatus in a first embodiment of the present invention.

An embodiment of the present invention will be described with reference to the attached drawings. A liquid supplying apparatus in the present embodiment is exemplified by an ink supplying apparatus for supplying ink to an inkjet print head (i.e., a liquid ejection head) capable of ejecting ink (i.e., liquid). The ink supplying apparatus in the present embodiment is provided for an inkjet printing apparatus (i.e., a liquid ejecting apparatus). FIG. 1 is a view used in explaining the basic configuration of the ink supplying apparatus.

The ink supplying apparatus in the present embodiment includes a print head 1 capable of ejecting ink, an ink tank (i.e., a liquid container) 2, and a pressure regulating unit 3. These members are connected to each other via ink tubes 5 (5A, 5B, and 5C). The pressure regulating unit 3 is provided on an ink supply channel (i.e., a liquid supply channel) between the print head 1 and the ink tank 2. The print head 1 is provided with a print element board 7 including a plurality of ejection ports for ejecting ink droplets and a plurality of ejection energy generating elements, and thus, is configured to eject an ink droplet (i.e., a liquid droplet) 6 from the ejection port by utilizing ejection energy generated by each of the ejection energy generating elements. An electrothermal transducer (i.e., a heater), a piezoelectric element, or the like may be used as the ejection energy generating element. In the case of the use of the electrothermal transducer, ink is foamed by the generated heat, and thus, the ink droplet 6 can be ejected from the ejection port by utilizing the foaming energy.

An inkjet printing apparatus provided with the above-described ink supplying apparatus includes a moving mechanism for relatively moving the print head 1 and a print medium and a control unit for ejecting the ink droplet 6 from the print head 1 based on image data. The printing apparatus relatively moves the print head 1 and the print medium while ejecting the ink droplet 6 from the print head 1 so as to print an image on the print medium. The above-described printing apparatus may be of either a full line type or a serial scan type. The printing apparatus of a full line type sequentially conveys the print medium while ejecting ink from the print head so as to print an image. In the meantime, the printing apparatus of a serial scan type prints an image by repeating an operation for moving the print head in a main scanning direction while ejecting ink and an operation for conveying the print medium in a sub scanning direction crossing the main scanning direction.

Figure 8:
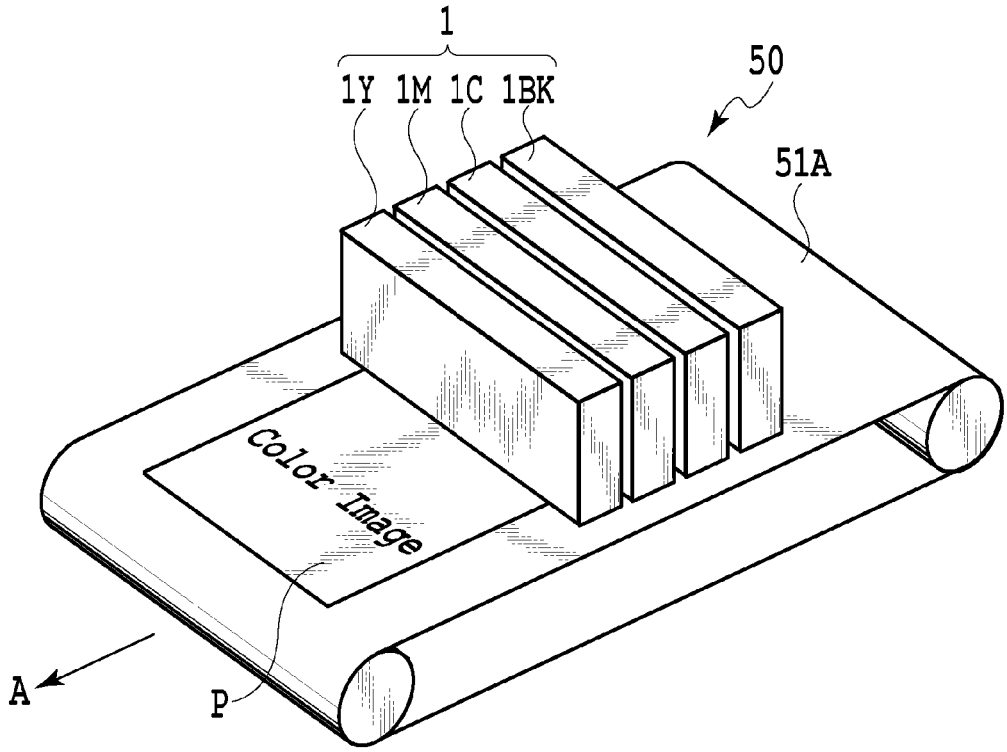
FIG. 8 is a view schematically showing the configuration of an inkjet printing apparatus that can be provided with the ink supplying apparatus shown in FIG. 1.

FIG. 8 is a schematically perspective view used in explaining a specific constitutional example of the inkjet printing apparatus of a full line type. The printing apparatus in the present embodiment is provided with the print heads 1 (1Bk, 1C, 1M, and 1Y) for ejecting black (Bk), cyan (C), magenta (M), and yellow (Y) inks. A print medium P is conveyed in a direction indicated by an arrow A by a conveyance mechanism 50 using a conveyance belt 51A. In order to supply the inks corresponding to the print heads 1, respectively, each of the print heads 1 is provided with the ink supplying apparatus shown in FIG. 1. The plurality of ejection ports capable of ejecting the ink are formed at each of the print heads 1. The ejection ports form an ejection port array extending in a direction crossing (in the present embodiment, perpendicular to) the conveyance direction (i.e., the direction indicated by the arrow A) of the print medium P. While conveying the print medium P in the direction indicated by the arrow A by the conveyance mechanism 50, the inks are ejected from the print heads 1, so that a color image can be printed on the print medium P.

In FIG. 1, the ink tank 2 and the pressure regulating unit 3 communicate with each other via the ink tube 5A. Driving a pressurizing pump 4A allows the ink contained in the ink tank 2 to be fed to the pressure regulating unit 3. The pressure regulating unit 3 and the print head 1 communicate with each other via the ink tube 5B. Therefore, the ink whose pressure is regulated in the pressure regulating unit 3 is supplied to the print head 1. One end of the ink tube 5B communicates with an ink inlet 11 formed at the print head 1, and thus, the ink having a negative pressure applied thereto, as described above, is fed to an ink channel 9 inside of the print head 1 from the pressure regulating unit 3. The ink staying in the ink channel 9 is fed to the print element board 7, and then, is ejected from the ejection port in the form of an ink droplet 6 by an ejection energy generating element such as an electrothermal transducer. The ink channel 9 communicates with an ink outlet 12 that communicates with the ink tank 2 via the ink tube 5C. Driving a suction pump 4B allows the ink staying in the print head 1 to be sucked and fed to the ink tank 2.

In the print head 1 in the present embodiment, the plurality of print element boards 7 are arranged in a zigzag on a base board 8, thus configuring an elongate print head for use in the inkjet printing apparatus of a so-called full line type. The above-described print head 1 is suitable for a business-grade printing apparatus that requires printing a wide image at a high speed. The number of print element boards 7 to be arranged is not limited to six, like the present embodiment. A wider image can be printed by increasing the number of print element boards 7 to be arranged. With the above-described print head 1, as wide an image as 4 to 12 inches can be printed at a high speed.

On the base board 8 are mounted a plurality of thermally insulating members 13 made of a resin as support members for supporting their respective print element boards 7. Inside of each of the thermally insulating members 13 is formed an independent liquid chamber 10 for allowing the ink channel 9 in the base board 8 and the print element board 7 to communicate with each other. Consequently, the ink supplied to the ink inlet 11 at the base board 8 is supplied to the print element board 7 through the ink channel 9 and the independent liquid chamber 10, to be thus ejected from the ejection port in the form of the ink droplet 6.

Figure 2:
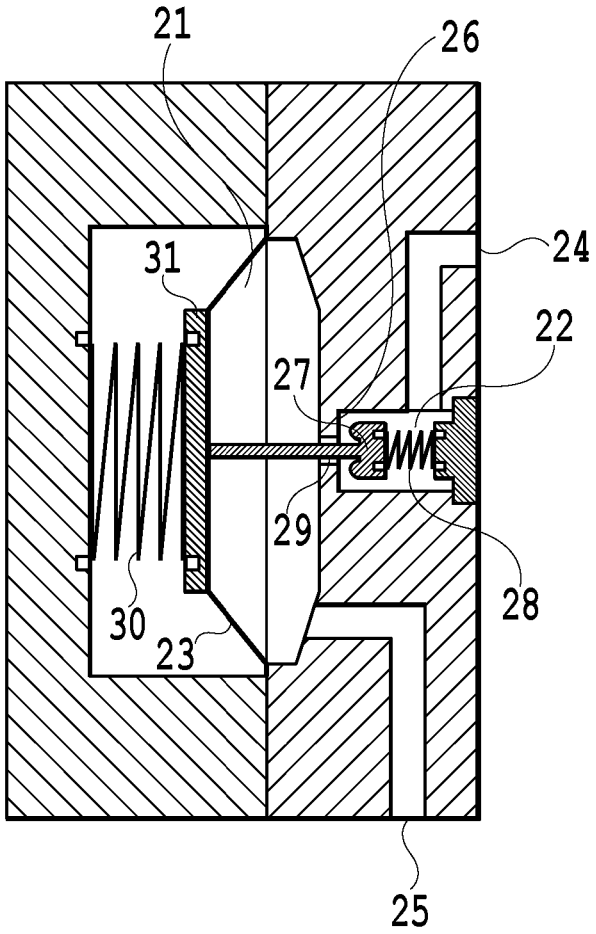
FIG. 2 is a cross-sectional view showing a pressure regulating unit in FIG. 1.

FIG. 2 is a cross-sectional view showing the pressure regulating unit 3. A part of a pressure chamber is formed of a displacement member that is displaced according to pressure inside of the pressure chamber 21. In the present embodiment, a film (i.e., a flexible member) 23 formed of a flexible film is used as the displacement member. The film 23 may be formed in various planar shapes such as a circle, an ellipse, and a rectangle. Any displacement members may be used and are not limited to the flexible member as long as they can be displaced according to the pressure inside of the pressure chamber 21. At the main body of the pressure regulating unit 3, an ink inlet 24 communicating with the ink tube 5A and an ink outlet 25 communicating with the ink tube 5B are formed. The ink inlet 24 communicates with an ink introducing chamber (i.e., a first pressure chamber) 22 capable of introducing the ink inside of the pressure regulating unit 3. In the meantime, the ink outlet 25 communicates with the pressure chamber (i.e., a second pressure chamber) 21 capable of leading out the ink from the inside of the pressure regulating unit 3. The ink that is fed from the ink tank 2 through the ink tube 5A is supplied to the print head 1 through the ink inlet 24, the ink introducing chamber 22, an ink communication path 29, the pressure chamber 21, and the ink outlet 25.

The ink communication path 29 is disposed with a valve capable of adjusting the opening degree thereof. The valve includes a valve seat 26 formed at the opening of the ink communication path 29 and a valve body 27 that can be brought into or out of contact with the valve seat 26. The valve body 27 is urged in a direction (leftward in FIG. 2) in which the valve body 27 is brought into contact with the valve seat 26 by an urging member 28. In a case where the valve body 27 is brought into close contact with the valve seat 26, it closes the ink communication path 29. The urging member (i.e., a first urging member) 28 urges the valve seat 26 in a direction in which the ink communication path 29 is closed. Other than a spring such as a coil spring, like the present embodiment, various resilient members such as a diaphragm may be used as the urging member 28. The displacement of the film 23 is transmitted to the valve body 27, which thus opens or closes the ink communication path 29 in association with the displacement of the film 23.

A pressure plate 31 is disposed at the outer surface of the film 23 positioned outside of the pressure chamber 21. The pressure plate 31 is urged rightward in FIG. 2 together with the film 23 and the valve body 27 by an urging member (i.e., a second urging member) 30. The urging member 30 urges, via the pressure plate 31, the film rightward in FIG. 2, that is, in a displacement direction in which the volume of the pressure chamber 21 is reduced, thereby pressurizing the inside of the pressure chamber 21. Furthermore, the urging member 30 is adapted to urge the valve body 27 in a direction in which the ink communication path 29 is opened. Other than a spring such as a coil spring, like the present embodiment, various resilient members such as a diaphragm may be used as the urging member 30. The spring constant of the urging member 30 is greater than that of the urging member 28.

Next, the operation of the pressure regulating unit 3 will be described below.

Figure 3A:
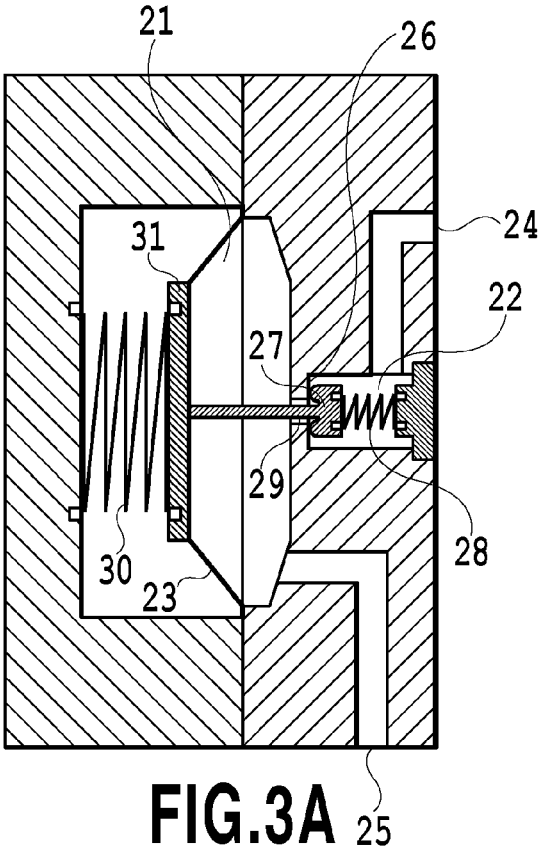
FIGS. 3A and 3B are cross-sectional views showing the operation of the pressure regulating unit shown in FIG. 2.
Figure 3B:
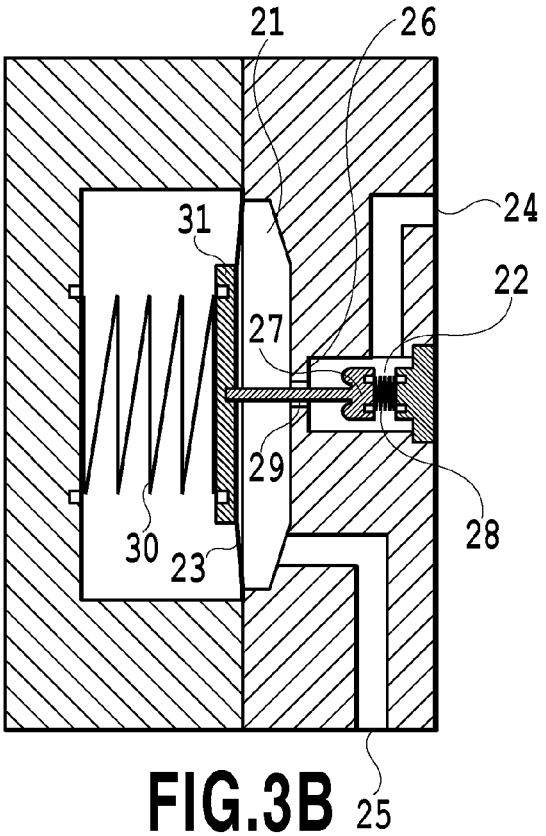

In a case where negative pressure inside of the pressure chamber 21 is low, the valve body 27 is brought into close contact with the valve seat 26, thus closing the ink communication path 29, as shown in FIG. 3A. The negative pressure inside of the pressure chamber 21 is increased according to the ejection of the ink from the print head 1, that is, the consumption of the ink. In a case where the negative pressure inside of the pressure chamber 21 becomes a predetermined value or higher, the film 23 is displaced together with the pressure plate 31 and the valve body 27 in the direction in which the volume of the pressure chamber 21 is reduced, as shown in FIG. 3B. The valve body 27 is separated from the valve seat 26 according to the displacement amount, thus opening the ink communication path 29. In this manner, the ink pressurized by the pressurizing pump 4A is supplied to the print head 1 through the ink inlet 24, the ink introducing chamber 22, the ink communication path 29, the pressure chamber 21, and the ink outlet 25.

A pressure P3 of the ink staying in the print head 1 can be expressed by the following equation (1). Here, P2 denotes a pressure of the ink staying in the pressure chamber 21; R1 denotes a channel resistance between the pressure chamber 21 and the print head 1; and Q denotes a flow rate of the ink flowing in the print head 1 from the pressure regulating unit 3.

$$P3=P2-(R1\times Q) \quad \text{Equation (1)}$$

The pressure P3 of the ink staying in the print head 1 is decreased, that is, the negative pressure of the ink staying in the print head is increased as the flow rate Q of the ink flowing in the print head 1 from the pressure regulating unit 3 is increased. Therefore, in a case where an ink ejection quantity per unit time in the print head 1 is large, the negative pressure of the ink in the vicinity of the ejection port becomes high, thereby possibly inducing ink ejection deficiency. In order to suppress ink ejection deficiency, it is effective to increase the pressure P2 inside of the pressure chamber 21, that is, the negative pressure inside of the pressure chamber 21 is decreased as the ink flow rate Q is increased so that the negative pressure of the ink in the vicinity of the ejection port is suppressed within a range in which no ink ejection deficiency occurs.

In the state in which the ink pressurized by the pressurizing pump 4A is supplied into the pressure chamber 21, in a case where force of the valve body 27 for opening the ink communication path 29 and force of the valve body 27 for closing the ink communication path 29 balance with each other, the following equation (2) is established.

$$-(P2\times S2)+F2=(P1\times S1)+F1 \quad \text{Equation (2)}$$

Figure 4:
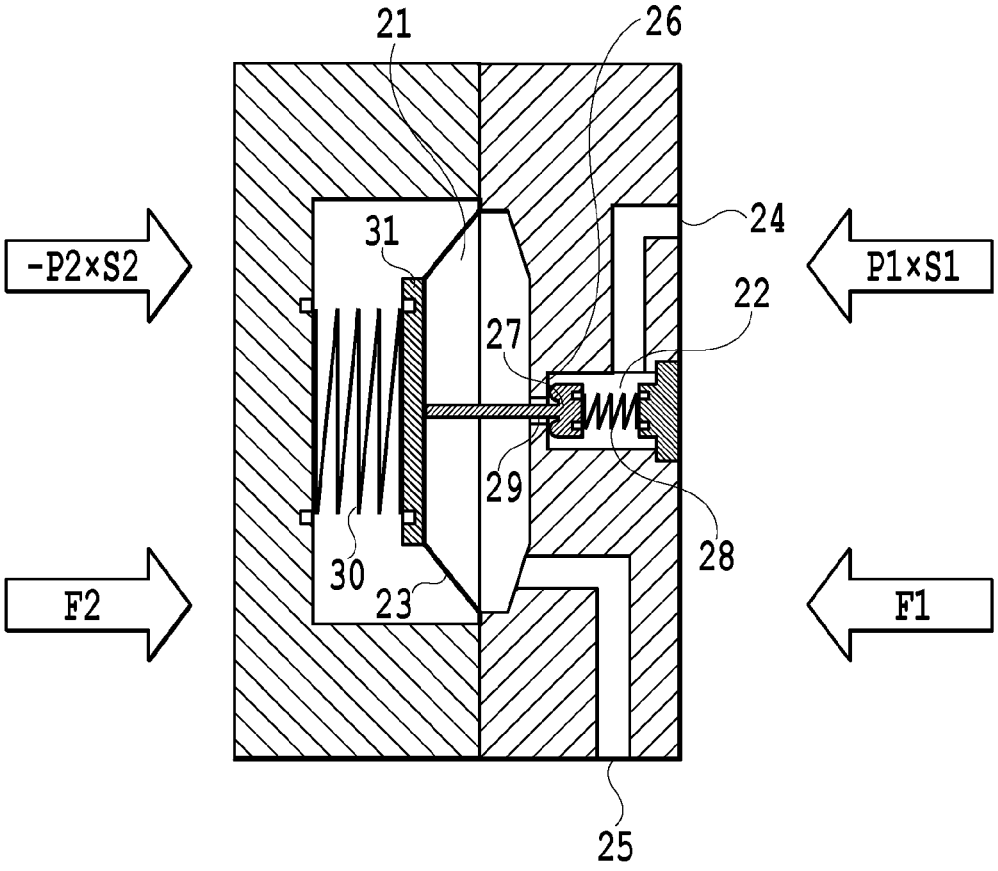
FIG. 4 is a cross-sectional view used in explaining pressure inside of the pressure regulating unit shown in FIG. 2.

Here, P1 denotes a pressure of the ink staying in the ink introducing chamber 22. S2 denotes an area of the film 23, with which the pressure plate 31 is brought into contact, that is, an area of the film 23 positioned inside of the pressure chamber 21 and restricted by the pressure plate 31. S1 denotes an area of a surface of the valve body 27 inside of the ink introducing chamber 22, and parallel to the pressure plate 31. F1 denotes an urging force of the urging member 28 acting in the direction in which the ink communication path 29 is closed. F2 denotes an urging force of the urging member 30 acting in the direction in which the ink communication path 29 is opened. As shown in FIG. 4, the pressure of the ink staying in the pressure chamber 21 is a negative pressure.

The above-described equation (2) may be changed into the following equation (3).

$$P2=-(P1\times S1)/S2-(F1/S2)+(F2/S2) \quad \text{Equation (3)}$$

Since the spring constant of the urging member 30 in the present embodiment is greater than that of the urging member 28, the volume of the pressure chamber 21 becomes small as the flow rate Q of the ink flowing in the print head 1 from the pressure regulating unit 3 is increased so that the opening degree of the ink communication path 29 is increased. Thus, as the ink flow rate Q is increased, the pressure P2 inside of the pressure chamber 21 is increased, that is, the negative pressure inside of the pressure chamber 21 becomes low. Consequently, the negative pressure of the ink in the vicinity of the ejection port can be suppressed within the range in which no ink ejection deficiency occurs.

Example 1

Figure 5:
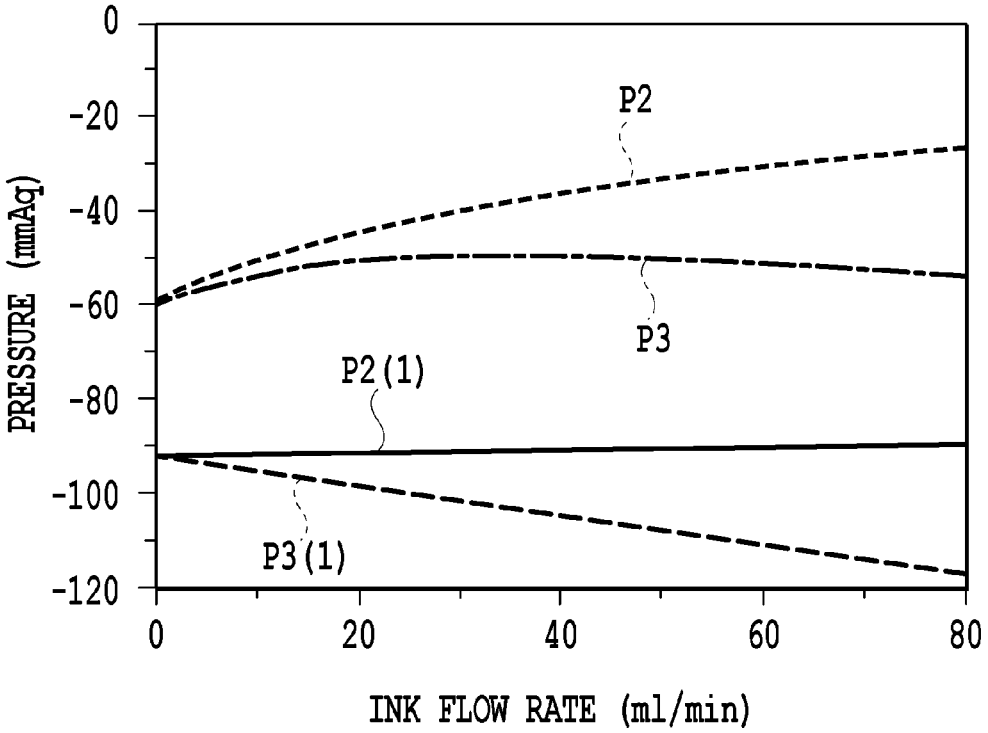
FIG. 5 is a graph illustrating a change in pressure in an example 1 of the present invention and a comparative example 1.

In Example 1, the pressure regulating unit 3 shown in FIG. 2 was fabricated under the condition shown in Table (1)

below, thus configuring the ink supplying apparatus shown in FIG. 1. The print head 1 was driven under the condition shown in Table (2) below. The pressure P2 of the ink staying inside of the pressure chamber 21 and the pressure P3 of the ink in the print element board 7 at that time are shown in FIG. 5.

TABLE (1)

| | |
|---|---|
| Area S1 of valve body ($mm^2$) | 4.5 |
| Area S2 of pressure plate ($mm^2$) | 530 |
| Spring constant of urging member (28) (gf/mm) | 5 |
| Initial urging force of urging member (28) (gf) | 0 |
| Spring constant of urging member (30) (gf/mm) | 805 |
| Initial urging force of urging member (30) (gf) | 0 |

TABLE (2)

| | |
|---|---|
| Print speed (ips) | 6 |
| Drive frequency (kHz) | 7.2 |
| Ink circulation quantity (mL/min) | 0-80 |
| Pressure of pressurizing pump (4A) (kPa) | 100 |

Figure 6:
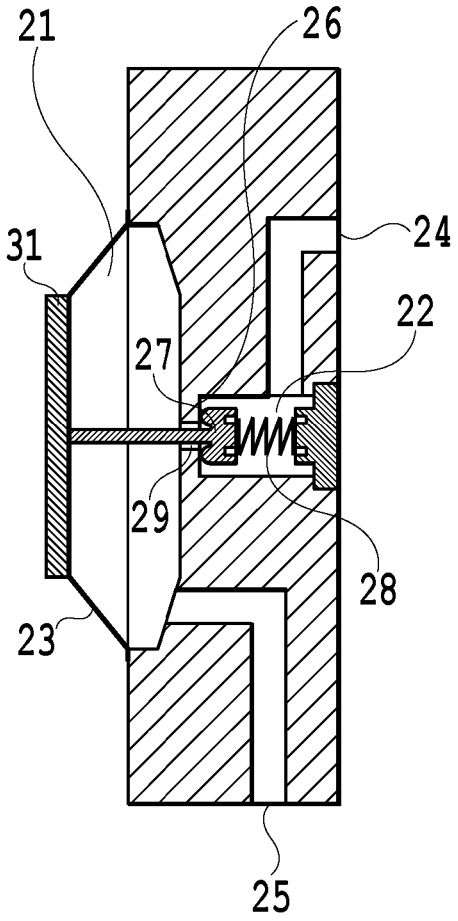
FIG. 6 is a cross-sectional view showing a pressure regulating unit in the comparative example 1.

In Comparative Example 1, the pressure regulating unit shown in FIG. 6 was fabricated, and then, it was provided for the ink supplying apparatus shown in FIG. 1. The pressure regulating unit shown in Comparative Example 1 was such configured that the urging member 30 was detached from the pressure regulating unit 3 shown in FIG. 2, and was fabricated under the condition shown in Table (3) below. In FIG. 6 when force of the valve body 27 for opening the ink communication path 29 and force of the valve body 27 for closing the ink communication path 29 balance with each other, the following equation (4) is established.

$$-(P2\times S2)=(P1\times S1)+F1 \quad \text{Equation (4)}$$

Here, symbols are identical to those in Equation (2) above.

The above-described equation (4) may be changed into the following equation (5).

$$P2=-(P1\times S1)/S2-(F1/S2) \quad \text{Equation (5)}$$

The print head 1 was driven under the condition shown in Table (2). A pressure P2(1) of the ink staying in the pressure chamber 21 and a pressure P3(1) of the ink in the print element board 7 at that time are shown in FIG. 5.

TABLE (3)

| | |
|---|---|
| Area S1 of valve body ($mm^2$) | 4.5 |
| Area S2 of pressure plate ($mm^2$) | 530 |
| Spring constant of urging member (28) (gf/mm) | 5 |
| Initial urging force of urging member (28) (gf) | 0 |

As is obvious from FIG. 5, in the pressure regulating unit 3 in Example 1, the pressure P2 of the ink staying in the pressure chamber 21 is increased as the ink ejection quantity is increased. Thus, a change in pressure P3 according to the increase in ink flow rate Q can be suppressed to a low level. As a consequence, it is possible to stably maintain the pressure (i.e., the negative pressure) of the ink in the vicinity of the ejection port, so as to print an image of a high quality even during high-speed printing. In this manner, the function of the urging member 30 produces the above-described effects in the present embodiment. Specifically, as it is found from the comparison between Equation (3) in the present embodiment and Equation (5) in Comparative Example 1, the function of F2/S2 in Equation (3), that is, the function of the urging member 30 produces the above-described effects.

In contrast, in the pressure regulating unit 3 in Comparative Example 1, a change in pressure P2(1) of the ink staying in the pressure chamber 21 is small in a case where the ink flow rate Q is increased. Therefore, the pressure P3(1) is largely changed by a pressure loss between the pressure chamber 21 and the print element board according to the increase in ink flow rate Q, thereby increasing the negative pressure of the ink in the print element board 7. Consequently, although the pressure P2(1) of the ink staying in the pressure chamber 21 in the pressure regulating unit 3 can be uniformly maintained, the negative pressure in the vicinity of the ejection port becomes high with a large pressure loss between the pressure chamber 21 and the print head 1, thereby possibly inducing ink ejection deficiency.

Example 2

Figure 7:
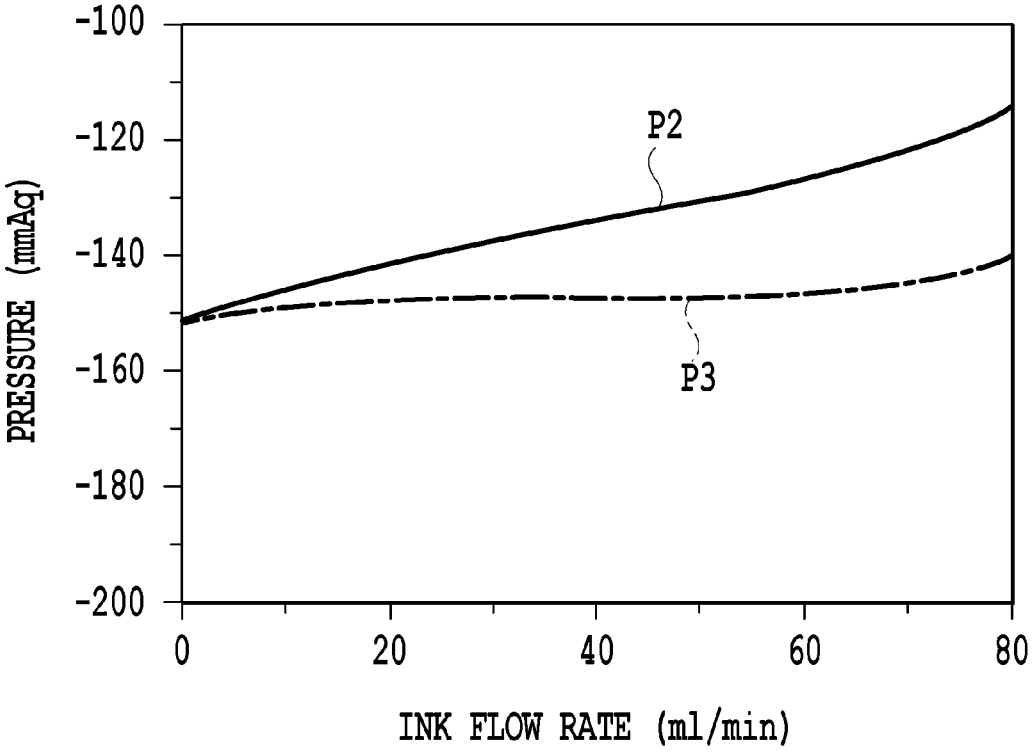
FIG. 7 is a graph illustrating a change in pressure in an example 2 of the present invention.

In Example 2, the pressure regulating unit 3 shown in FIG. 2 was fabricated under the condition shown in Table (4) below, thus configuring the ink supplying apparatus shown in FIG. 1. The print head 1 was driven under the condition shown in Table (2). The pressure P2 of the ink staying in the pressure chamber 21 and the pressure P3 of the ink in the print element board 7 at that time are shown in FIG. 7.

TABLE (4)

| | |
|---|---|
| Area S1 of valve body ($mm^2$) | 4.5 |
| Area S2 of pressure plate ($mm^2$) | 530 |
| Spring constant of urging member (28) (gf/mm) | 212.5 |
| Initial urging force of urging member (28) (gf) | 637.5 |
| Spring constant of urging member (30) (gf/mm) | 562.5 |
| Initial urging force of urging member (30) (gf) | 562.5 |

In the same manner as Example 1, the pressure P2 of the ink staying in the pressure chamber 21 is increased according to an increase in ink flow rate Q, so that a change in pressure P3 of the ink in the print element board 7 can be suppressed to a low level.

In Example 2, the initial urging force of the urging member 28 was set to be greater than that of the urging member 30, as shown in Table (4). Therefore, the pressure P2 of the ink staying in the pressure chamber 21 in a case where the ink communication path 29 is closed always becomes negative irrespective of the pressure of the ink staying in the ink introducing chamber 22. Consequently, there is no possibility of leakage of the ink from the ejection port of the print head 1 during the stoppage of the ink supplying apparatus, thus enhancing the reliability of the ink supplying apparatus and the inkjet printing apparatus.

Second Embodiment

Figure 9:
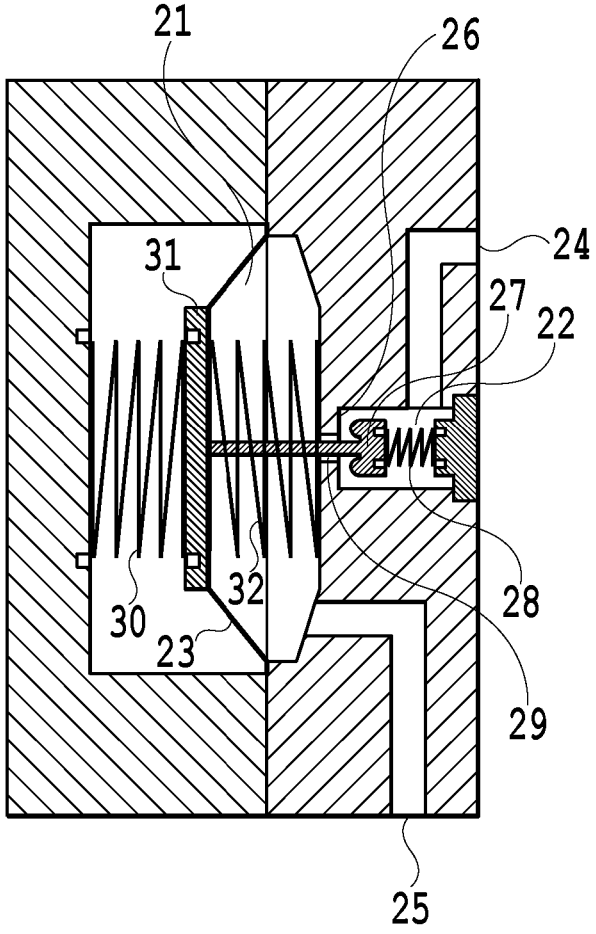
FIG. 9 is a cross-sectional view showing a pressure regulating unit in an example 3 of a second embodiment of the present invention.
Figure 10:
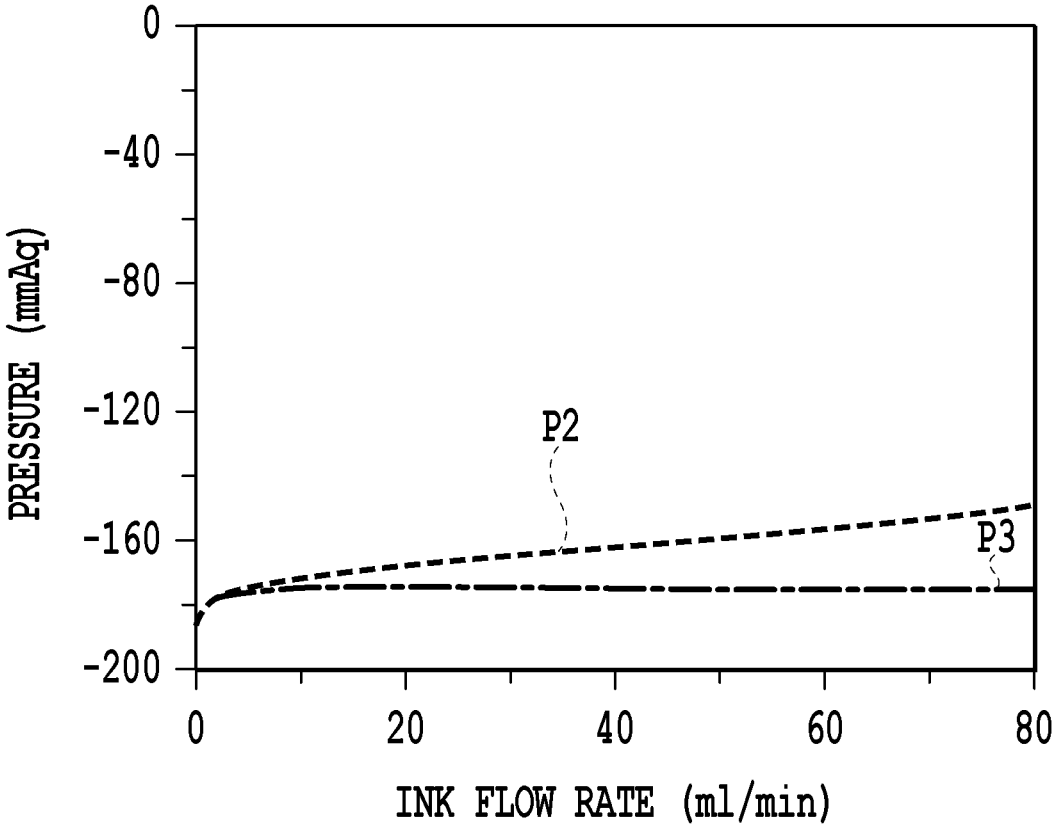
FIG. 10 is a graph illustrating a change in pressure in the Example 3 of the present invention.

A second embodiment will be described with reference to FIGS. 9 and 10. Explanation on constituent elements similar to those in the first embodiment will be omitted, and only a different configuration will be explained below. FIG. 9 shows the configuration of a pressure regulating unit 3 in the present embodiment. A feature different from that in the first embodiment resides in providing an urging member 32 (i.e., a third urging member) inside of a pressure chamber 21 in the present embodiment. The urging member 32 urges the valve seat 26 in the direction in which the ink communication path 29 is closed (in other words, the urging member 32 urges the valve seat 26 in a direction in which the urging member 32 expands), like the urging member 28.

The urging members in the present embodiment have the interrelationship such that the sum of spring constants of the urging member 28 (i.e., the first urging member) and the urging member 32 (i.e., the third urging member) is smaller than a spring constant of the urging member 30 (i.e., the second urging member), whatever the magnitude relationship between the spring constants of the urging member 28 (i.e., the first urging member) and the urging member 32 (i.e., the third urging member) may be. Other than a spring such as a coil spring, like the present embodiment, various resilient members such as a diaphragm may be used as the urging member 32. The urging member 32 enables to reinforce an urging force for closing the ink communication path 29. Furthermore, the urging member 32 produces an effect of suppressing any inclination of the pressure plate 31 by the influence of gravity or the like.

Example 3

In Example 3, the pressure regulating unit 3 shown in FIG. 9 was fabricated under the condition shown in Table (5) below. The pressure P2 of the ink staying in the pressure chamber 21 and the pressure P3 of the ink in a print element board 7 in a case where the print head 1 was driven under the condition shown in Table (2) are shown in FIG. 10.

TABLE (5)

| | |
|---|---|
| Area S1 of valve body ($mm^2$) | 4.5 |
| Area S2 of pressure plate ($mm^2$) | 530 |
| Spring constant of urging member (28) (gf/mm) | 212.5 |
| Initial urging force of urging member (28) (gf) | 212.5 |
| Spring constant of urging member (30) (gf/mm) | 562.5 |
| Initial urging force of urging member (30) (gf) | 562.5 |
| Spring constant of urging member (32) (gf/mm) | 220 |
| Initial urging force of urging member (32) (gf) | 440 |

In the same manner as Example 1, the pressure P2 of the ink staying in the pressure chamber 21 is increased according to an increase in ink flow rate Q, so that a change in pressure P3 of the ink in the print element board 7 can be suppressed to a low level. Consequently, it is possible to stably maintain the pressure (i.e., the negative pressure) of the ink in the vicinity of the ejection port, so as to print an image of a high quality even during high-speed printing.

INDUSTRIAL APPLICABILITY

The present invention is widely applicable to a pressure regulating unit for regulating the pressure of each of various kinds of liquids, a liquid supplying apparatus for supplying each of various kinds of liquids, and a liquid ejecting apparatus capable of ejecting each of various kinds of liquids. Furthermore, the present invention is applicable to a liquid ejection apparatus for applying various kinds of processing (such as printing, processing, coating, irradiating, reading, and inspecting) to each of various kinds of mediums (e.g., a sheet) by using a liquid ejection head capable of ejecting liquid. Examples of the medium (including a print medium) include various mediums such as paper, plastic, a film, fabric, metal, and a flexible board, to which liquid such as ink is applied, whatever the material may be.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2014-093717, filed Apr. 30, 2014, and No. 2015-034164, filed Feb. 24, 2015, which are hereby incorporated by reference wherein in their entirety.

What is claimed is:

1. A liquid supplying apparatus for supplying a liquid to a liquid ejection head capable of ejecting the liquid comprising:

a liquid container configured to contain the liquid;

a pressure regulating unit provided in a liquid supply channel communicating between the liquid container and the liquid ejection head; and a pressurizing pump, wherein the pressure regulating unit comprises:

a first pressure chamber capable of introducing the liquid therein;

a second pressure chamber capable of leading out the liquid therefrom, at least a part of the second pressure chamber being defined by a displacement member that is displaced according to an inside pressure;

a communication path that allows the first pressure chamber and the second pressure chamber to communicate with each other;

a valve capable of adjusting the opening degree of the communication path according to the displacement of the displacement member;

a first urging unit configured to apply an urging force to the valve, the urging force of the first urging unit acting in a direction in which the communication path is closed; and a second urging unit configured to apply an urging force to the displacement member, the urging force of the second urging unit acting in a displacement direction in which the volume of the second pressure chamber is reduced, wherein a spring constant of the second urging unit being greater than a spring constant of the first urging unit, wherein the pressurizing pump is provided in a liquid supply channel communicating between the liquid container and the pressure regulating unit and is configured to supply the liquid in the liquid container to the pressure regulating unit.

2. The liquid supplying apparatus according to claim 1, wherein the valve increases the opening degree of the communication path according to a displacement amount of the displacement member in the displacement direction in which the volume of the second pressure chamber is reduced.

3. The liquid supplying apparatus according to claim 1, wherein an initial urging force of the first urging unit is greater than an initial urging force of the second urging unit.

4. The liquid supplying apparatus according to claim 1, wherein the displacement member is a flexible member.

5. The liquid supplying apparatus according to claim 1, wherein the valve includes a valve seat formed at an opening of the communication path and a valve body that is brought into or out of contact with the valve seat in association with the displacement of the displacement member.

6. The liquid supplying apparatus according to claim 1, comprising a suction pump configured to suck the liquid staying in the liquid ejection head so as to return the liquid to the liquid container.

7. A liquid ejecting apparatus comprising:

the liquid supplying apparatus according to claim 1; and the liquid ejection head capable of ejecting the liquid to be supplied from the liquid supplying apparatus.

8. An inkjet printing apparatus comprising:

the liquid supplying apparatus according to claim 1, the liquid supplying apparatus supplying an ink serving as the liquid;

an inkjet printing head configured to eject the ink to be supplied from the liquid supplying apparatus; and a moving unit configured to relatively move the inkjet printing head and a print medium.

* * * * *